US009916824B2

(12) United States Patent
Takehisa

(10) Patent No.: US 9,916,824 B2
(45) Date of Patent: Mar. 13, 2018

(54) ELECTRONIC PERCUSSION CONTROLLER, INSTRUMENT AND METHOD

(71) Applicant: Yamaha Corporation, Hamamatsu Shizuoka (JP)

(72) Inventor: Hideaki Takehisa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 15/435,752

(22) Filed: Feb. 17, 2017

(65) Prior Publication Data

US 2017/0249930 A1 Aug. 31, 2017

(30) Foreign Application Priority Data

Feb. 26, 2016 (JP) ..... 2016-035380

(51) Int. Cl.

| | |
|---|---|
| ***G10H 1/22*** | (2006.01) |
| ***G10H 7/00*** | (2006.01) |
| ***G10H 1/00*** | (2006.01) |
| ***G10H 1/18*** | (2006.01) |
| ***H04H 60/05*** | (2008.01) |

(52) U.S. Cl.

CPC ..... *G10H 7/00* (2013.01); *G10H 1/0008* (2013.01); *G10H 1/18* (2013.01); *H04H 60/05* (2013.01); *G10H 2220/021* (2013.01); *G10H 2230/281* (2013.01); *G10H 2250/435* (2013.01)

(58) Field of Classification Search

CPC ..... G10H 7/00; G10H 1/0008; G10H 1/18; G10H 2220/021; G10H 2230/281; G10H 2250/435; H04H 60/05

USPC ..... 84/618

See application file for complete search history.

(56) References Cited

U.S. PATENT DOCUMENTS

| | | | | |
|---|---|---|---|---|
| 5,009,146 A * | 4/1991 | Manabe | G10H 1/055 | 84/615 |
| 5,247,128 A * | 9/1993 | Suzuki | G10H 1/186 | 84/611 |
| 5,399,801 A * | 3/1995 | Hasebe | G10H 1/42 | 84/622 |
| 5,469,370 A * | 11/1995 | Ostrover | G10H 1/363 | 348/E5.099 |
| 5,670,732 A * | 9/1997 | Utsumi | G10H 1/0066 | 84/645 |
| 6,198,030 B1 * | 3/2001 | Rose | G10H 1/44 | 84/290 |
| 8,513,513 B2 | 8/2013 | Komano | | |
| 9,633,638 B2 * | 4/2017 | Lim | G10H 1/0058 | |

(Continued)

FOREIGN PATENT DOCUMENTS

JP 5724231 B2 5/2015

*Primary Examiner* — Jeffrey Donels

(74) *Attorney, Agent, or Firm* — Global IP Counselors, LLP

(57) ABSTRACT

An electronic percussion instrument controller includes a selection input device, a setting input device and a processor. The selection input device is configured to select an instrument which defines a tone that corresponds to a musical performance input device. The setting input device is configured to selectively set a tone lock for the musical performance input device. The processor is programmed to maintain a set tone of the musical performance input device for which the tone lock is set by the setting device.

18 Claims, 7 Drawing Sheets

(56) References Cited

U.S. PATENT DOCUMENTS

2010/0319519 A1* 12/2010 Takehisa ..... G10H 1/0066
84/723
2016/0042727 A1* 2/2016 Lim ..... G10H 1/0058
84/645

* cited by examiner

ELECTRONIC PERCUSSION CONTROLLER, INSTRUMENT AND METHOD

CROSS-REFERENCE TO RELATED APPLICATION

This application claims the benefit of Japanese Patent Application No. 2016-035380, filed on Feb. 26, 2016, the entire contents of Japanese Patent Application No. 2016-035380 being incorporated herein by reference.

BACKGROUND

Field of the Invention

The present invention relates to an electronic percussion controller for an electronic percussion instrument. More particularly, the present invention relates to an electronic percussion controller that is operable to fix a tone of one or more musical performance input devices.

Description of the Related Art

Conventionally, an electronic percussion instrument including a plurality of musical performance input devices to which tones are assigned has been known. For example, Japanese Patent No. 5724231 describes an electronic drum kit in which a set of tones are assigned to a plurality of pads acting as musical performance input devices. Since the assignment of the tones to the pads differs for each drum kit, it is possible to change the tones that are set for the pads all at once by changing the drum kit.

SUMMARY

However, depending on the user, there are cases in which it is desirable that a particular pad always plays a fixed sound. For example, if an additional pad is purchased in order to generate the sound of a splash cymbal, then it may be desirable for the additional pad to be set in a particular position and always plays the sound of the splash cymbal. In this case, if all of the musical performance input devices including the additional pad are automatically changed to other tones each time the tone kit is changed, it becomes necessary to modify the tone setting of the additional pad again to the tone of the splash cymbal, which is inconvenient. If a tone kit creation function is provided to newly create and register a tone kit, so that the tone of a particular pad will be common across a plurality of tone kits, the tone of the particular pad need not be changed when changing between such drum kits. However, such workarounds are cumbersome and not realistic.

The present invention was devised to solve the problem of the prior art described above. One object presented in the present disclosure is to provide an electronic percussion controller or an electronic percussion instrument that is capable of fixing a set tone of a desired musical performance input device even when the tone kit is changed.

In order to achieve the object described above, an electronic percussion instrument controller according to a disclosed embodiment comprises a selection input device, a setting input device and a processor. The selection input device is configured to select an instrument which defines a tone that corresponds to a musical performance input device. The setting input device is configured to selectively set a tone lock for the musical performance input device. The processor is programmed to maintain a set tone of the musical performance input device for which the tone lock is set by the setting device. Thus, it is possible to maintain the set tone of a desired musical performance input device even when the tone kit is changed.

In accordance with another aspect of the present disclosure, the electronic percussion instrument is also configured to provide a notification of the musical performance input device in which the set tone is fixed. Also in accordance with another aspect of the present disclosure, the electronic percussion instrument further makes it possible to avoid erroneously changing the set tone of the musical performance input device for which the set tone is fixed.

BRIEF DESCRIPTION OF THE DRAWINGS

Referring now to the attached drawings which form a part of this original disclosure.

Figure 1:
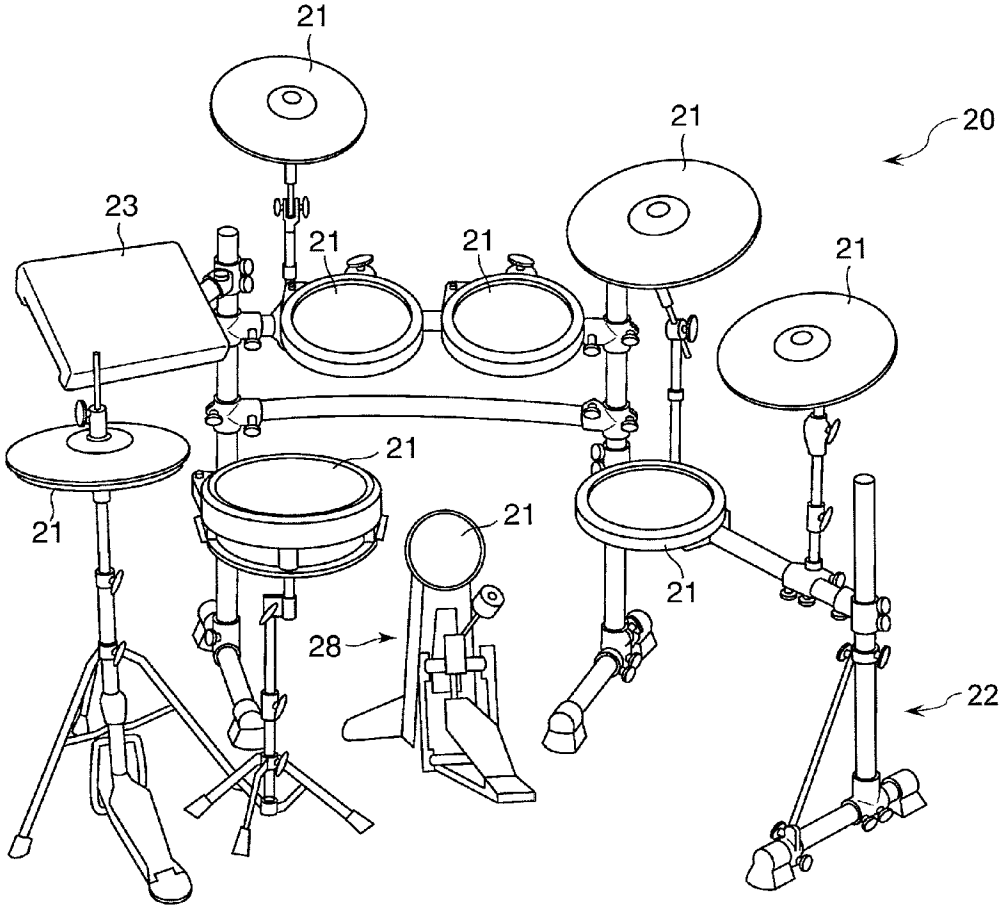
FIG. 1 is a perspective view of an example of an electronic percussion instrument according to a disclosed embodiment.

It should be noted that these figures are intended to illustrate the general characteristics of methods and structure utilized in the illustrative embodiment and to supplement the written description provided below. These drawings may not precisely reflect the precise structural or performance characteristics of any given embodiment, and should not be interpreted as defining or limiting the range of values or properties encompassed by illustrative embodiments unless specified.

DETAILED DESCRIPTION OF EMBODIMENTS

Selected embodiments will now be explained with reference to the drawings. It will be apparent to those skilled in the music field from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

FIG. 1 is a perspective view of an electronic percussion instrument 20 according to one exemplary embodiment of the present invention. The electronic percussion instrument 20 includes a plurality of pads 21, a stand 22, a controller 23 and a kick unit (bass drum unit) 28 that is placed on the floor surface. The pads 21 and the controller 23 are removably attached to the stand 22. The kick unit 28 also has one of the pads 21. Although the shapes of the pads 21 are different from each other, all of the pads will be referred to with the same reference numerical 21 for the sake of simplicity. Each of the pads 21 is electrically connected to the controller 23 via a wired or wireless link. Also, each of the pads 21 is provided with a sensor, which is not shown. Using these sensors, vibrations of the pads 21 are detected and detection signals are supplied to the controller 23 as understood in the art.

Figure 2:
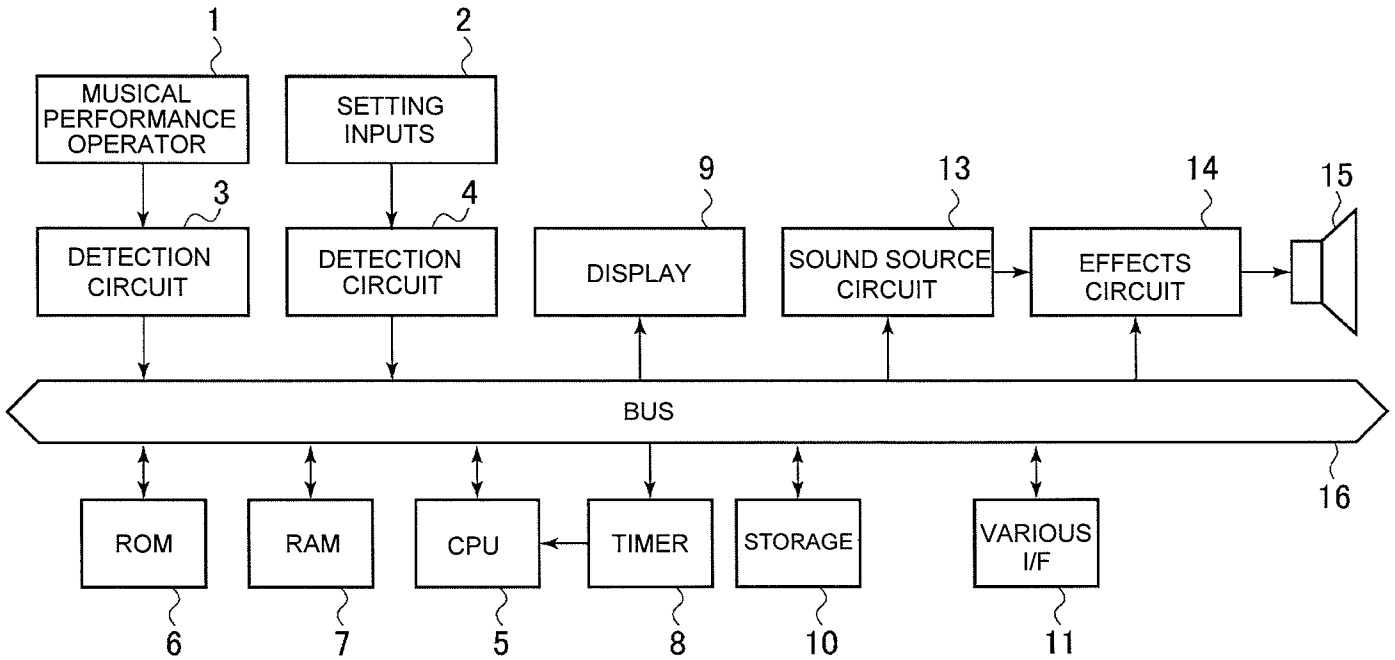
FIG. 2 is a block diagram representing an overall exemplary configuration of the electronic percussion instrument of FIG. 1.

FIG. 2 is a block diagram showing the overall configuration of the electronic percussion instrument 20. The controller 23 (FIG. 1) is includes a CPU 5. In addition to the CPU 5, the controller 23 further includes components or devices such as a plurality of setting inputs 2, a detection circuit 3, a detection circuit 4, a ROM (Read Only Memory) 6, a RAM (Random Access Memory) 7, a timer 8, a display 9, a storage 10, various I/F (interfaces) 11, a sound source circuit 13 and an effects circuit 14. These components or devices are all connected to the CPU 5 via a bus 16.

Still referring to FIG. 2, a musical performance operator 1 is depicted that includes, for example, the pads 21 shown in FIG. 1 (including the pad 21 of the kick unit 28) as musical performance input devices. The detection circuit 3 detects the operating state of the musical performance operator 1, and the detection circuit 4 detects the operating state of the setting inputs 2.

As understood in the art, the CPU 5 preferably includes a microcomputer with a control program that controls the electronic percussion instrument 20 as discussed herein. The CPU 5 can also include other conventional components such as an input interface circuit, an output interface circuit and storage devices. The ROM 6 and RAM 7 store processing results and control programs that are run by the CPU 5. The CPU 5 is operatively coupled to the components or devices of the electronic percussion instrument 20 as appropriate, in a conventional manner. It will be apparent to those skilled in the art from this disclosure that the precise structure and algorithms for the CPU 5 can be any combination of hardware and software that will carry out the functions of the present invention.

The display 9 is configured from an LCD, LED or any other suitable type of display device, and displays various types of information. The timer 8 is connected to the CPU 5. A sound system 15 is connected to the sound source circuit 13 via the effects circuit 14. The various I/F 11 include a MIDI (Musical Instrument Digital Interface) I/F and a communication I/F, as well as any other suitable type of I/F devices as understood in the art. The CPU 5 governs the control of the entire electronic percussion instrument 20, and includes at least one processor. The ROM 6 stores control programs that are executed by the CPU 5, as well as various table data, and the like. The RAM 7 temporarily stores various input data, various flags and buffer data, as well as calculation results and the like. The storage 10 is, for example, a nonvolatile memory such as flash memory, a hard drive, etc., and stores the control programs described above, various music data, various data, and the like. The sound source circuit 13 converts musical performance data input from the musical performance operator 1 and musical performance data, which are set in advance, into musical sound signals. The effects circuit 14 applies various effects to the musical sound signals that are input from the sound source circuit 13, and the sound system 15 configured from a DAC (Digital-to-Analog Converter), an amplifier, loudspeakers, and the like converts musical sound signals and the like that are input from the effects circuit 14 to acoustics. The CPU 5 generates sound from the sound system 15 by controlling the sound source circuit 13 and the effects circuit 14 based on the detection results of the detection circuit 3. Here, the setting of the tones of the sounds that are generated by striking the pads 21 will be described below in relation to FIG. 3 through FIG. 7.

Figure 3:
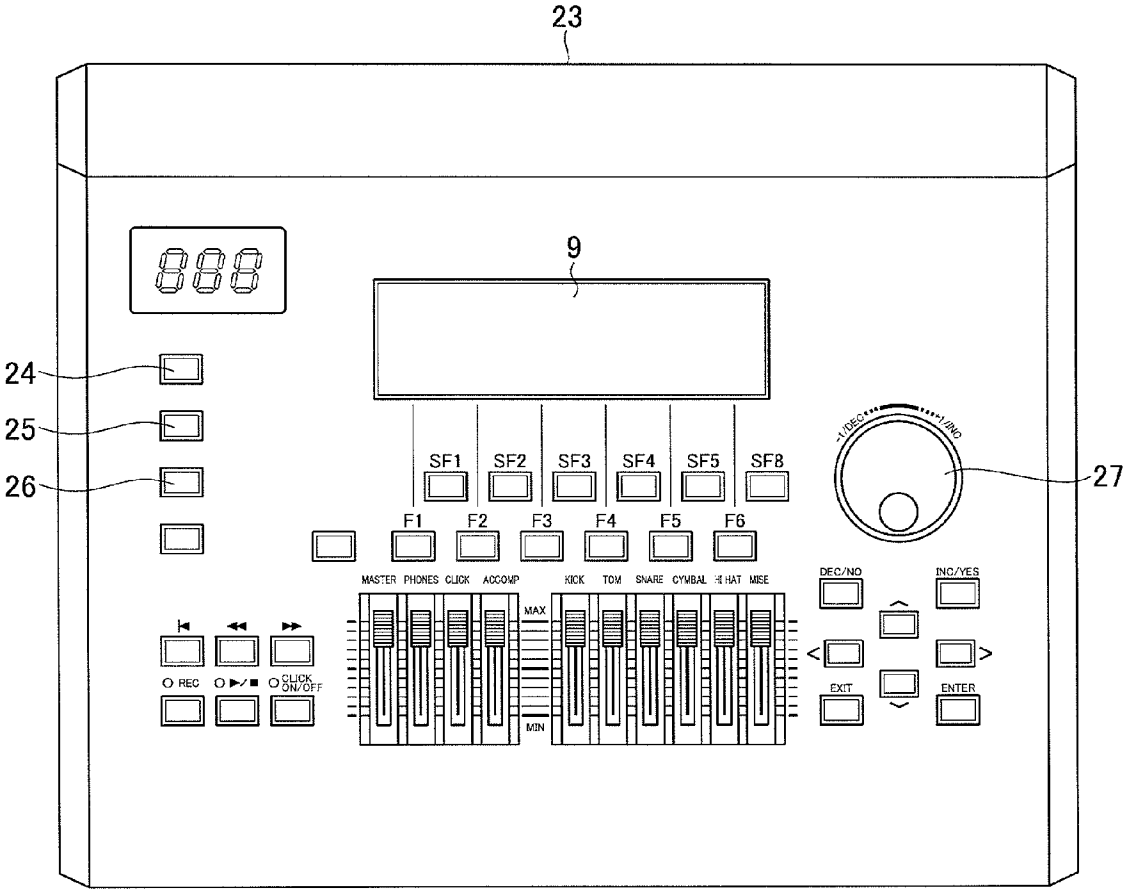
FIG. 3 illustrates an example of a controller in the electronic percussion instrument of FIG. 2.

FIG. 3 is a view showing an example of the controller 23. The display 9 described above is disposed on the upper surface of the controller 23. The upper surface of the controller 23 is provided with a dial switch 27, a KIT mode switch 24, a lock switch 25, and a tone selection mode switch 26. The dial switch 27 is rotationally operated. The KIT mode switch 24, the lock switch 25 and the tone selection mode switch 26 are each operated by pushing or touching. These switches 24, 25, 26 and 27 define a plurality of operators or a group of switches that are included in the setting inputs 2. As understood in the art, these setting inputs 2 (switches) are not limited to the illustrated embodiment, but rather can be any suitable types of input devices such as buttons, toggle switches, dials, touch pads and so on.

Figure 4A:
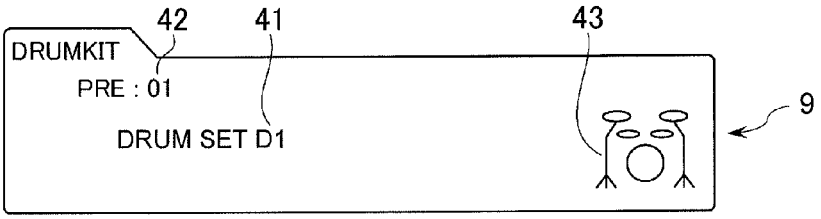
FIGS. 4A through 4D illustrate examples of displays that are displayed by a display of the controller of FIG. 2.
Figure 4B:
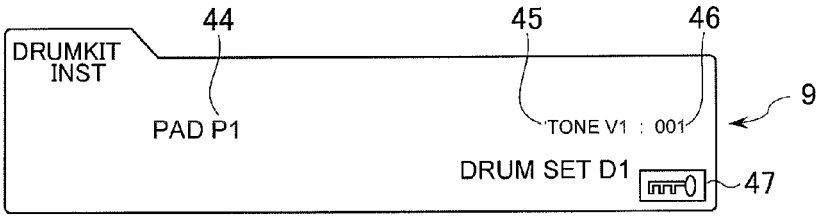
Figure 4C:
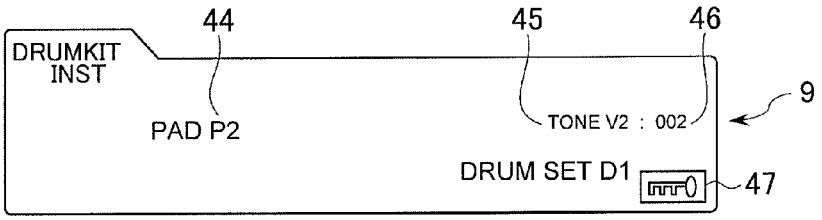
Figure 4D:
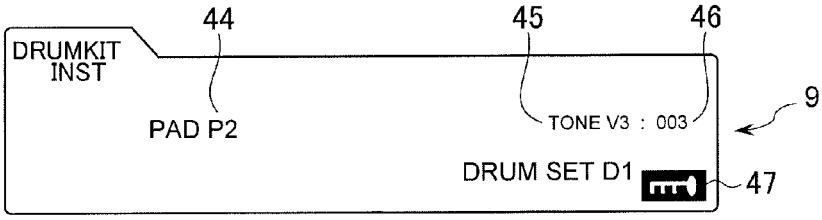

FIGS. 4A through 4D are views showing display examples of the display 9. In the present embodiment, a KIT mode and a tone selection mode are present as modes relating to tone setting. FIG. 4A shows a kit selection screen, which is displayed when in the KIT mode. FIGS. 4B through 4D show a tone setting screen, which is displayed when in the tone selection mode. Each time the KIT mode switch 24 is operated, it is toggled between transitioning to the KIT mode and returning back from the KIT mode. Furthermore, each time the tone selection mode switch 26 is operated, it is toggled between transitioning to the tone selection mode and returning back from the tone selection mode.

In the KIT mode, the kit selection screen (FIG. 4A) is displayed, and a drum kit (i.e., one example of a tone kit) is selected by the user. The tone kit (drum kit) is information that defines a set (drum set) in which tones that correspond to the respective pads 21 make one set, and that is stored in the storage 10 in advance. It is not necessary for the tone kit (drum kit to be stored by the electronic percussion instrument 20. Rather, the tone kit (drum kit can be configured to be obtained from an external device via the various I/F 11. In the illustrated embodiment, the drum set name 41 in the kit selection screen is the name of the drum kit that is currently being selected. The kit number 42 and the icon 43 are the number of the currently selected drum kit, and the corresponding icon display, respectively. The user can increase or decrease the kit number 42 by operating the dial switch 27, and the displays of the drum set name 41 and the icon 43 are also changed in response to a change in the kit number 42.

When in the tone selection mode of the KIT mode, the tone setting screen is displayed as shown in FIGS. 4B through 4D. In the tone setting screen, the target pad name 44 is the name of the pad 21 that is currently the target of changing and/or setting the tone (hereinafter referred to as the target pad). The set tone 45 and the tone number 46 are the name and the number, respectively, of the tone that is set in the target pad. The user can increase or decrease the tone number 46 by operating the dial switch 27, and the set tone 45 is also changed in response to a change in the tone number 46. In addition, switching of the target pad is carried out by the user striking the desired pad 21, and the struck pad 21 newly becomes the target pad. Here, the switching of the target pad is not limited to striking the pad 21, and can be carried out by other switch operations. In the initial screen of the KIT mode, the drum set is set to an initial setting target that is determined in advance. In the initial screen of the tone setting screen as well, the target pad and the tone are set to initial setting targets that are determined in advance.

Other than the above, a lock display 47 is displayed in the tone setting screen. In the tone selection mode, the lock display 47 is toggled each time the lock switch 25 (FIG. 3) is operated, and the display is inverted between a white state (FIGS. 4B and 4C) and a black state (FIG. 4D). When a tone lock is set to the target pad, the lock display 47 is put in a black state as shown in FIG. 4D. Although detailed control will be described in FIG. 7, if the tone lock is set, the set tone of the target pad is fixed to the current set tone and will be maintained even if there is an operation to change the drum kit. In addition, a change will be prohibited even if the user attempts an operation to change individual tones. In the example of FIG. 4D, a pad named "pad P2" is locked to a tone called "tone V3." A tone lock is not limited to one pad 21 and can be individually set to a plurality of desired pads 21. Thus, the lock switch 25, individually or in cooperation with the CPU 5, for example, can operate as a setting input device as discussed herein. Also, the display 9, individually or in cooperation with the CPU 5, for example, can operate as a display as discussed herein.

Figure 5:
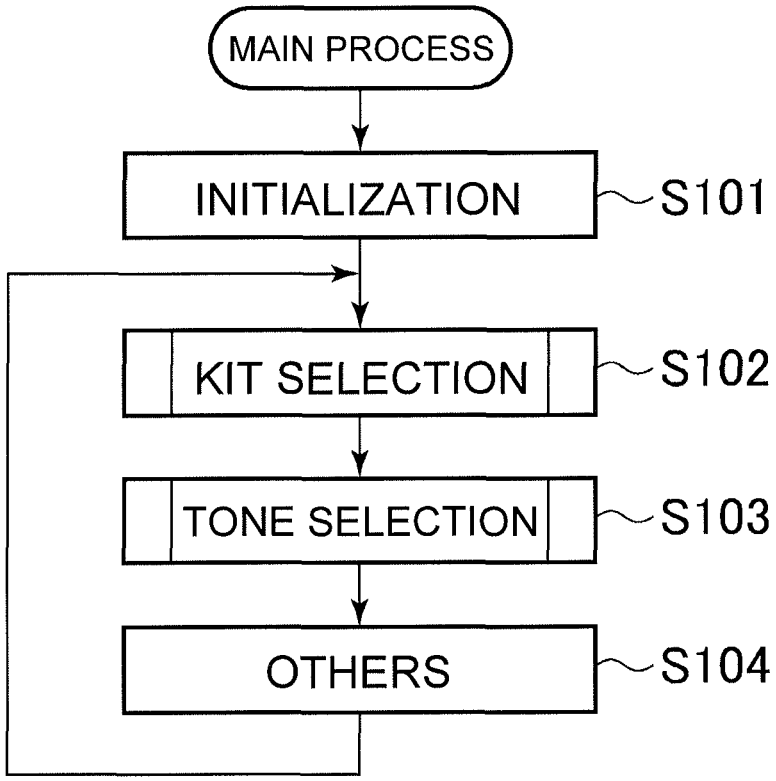
FIG. 5 is a flowchart illustrating an example of a process performed using the controller of FIG. 2.

FIG. 5 is a flowchart of a main process performed using the controller 23. The control program according to this flowchart is stored in the storage 10 or the ROM 6, is read by the RAM 7 and executed by the CPU 5. Here, the same effect can be exerted by reading from a storage medium, in which this control program is stored, to the electronic percussion instrument 20. The process shown in FIG. 5 is started by turning on the power to the electronic percussion instrument 20.

First, in Step S101, the CPU 5 executes an initialization, that is, starts to execute a predetermined program, and carries out an initial setting by setting initial values to various registers, such as the RAM 7. Next, the CPU 5 executes the kit selection process (FIG. 6) in Step S102, and the tone selection process (FIG. 7) in Step S103, and thus operates as a changing device to change the drum kit as well as the respective tone of each of the musical performance input devices as discussed herein. Next, the CPU 5 executes the other processes in Step S104, and the process returns to Step S102. In the other processes, other than the processes executed in the kit selection or the tone selection, setting of equipment based on operations of the setting operator 2, a sound generating process based on striking of the pad 21 and musical performance data, and the like are executed.

Figure 6:
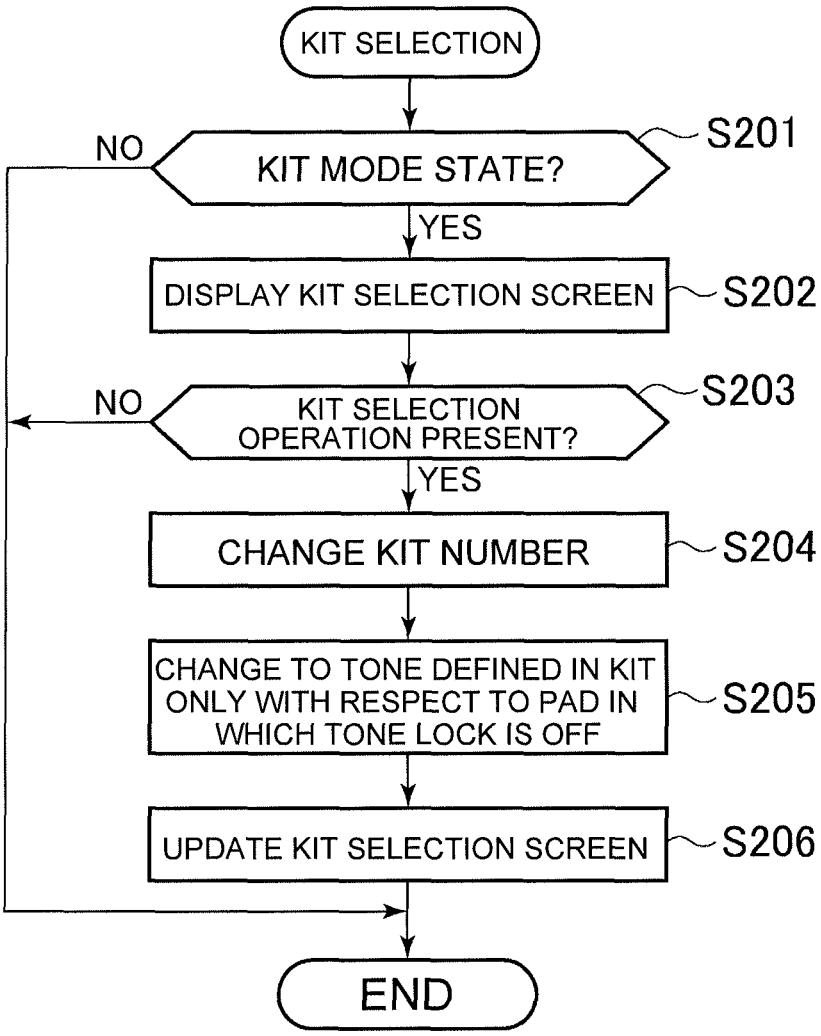
FIG. 6 is a flowchart illustrating an example of a kit selection process included in the process shown in the flowchart of FIG. 5.

FIG. 6 is a flowchart of the kit selection process executed in Step S102 in FIG. 5. First, the CPU 5 determines whether or not the electronic percussion instrument 20 is in the KIT mode state in Step S201, and ends the present process when not in the KIT mode state. If the electronic percussion instrument 20 is in the KIT mode state, the CPU 5 causes the display 9 of the controller 23 to display the kit selection screen (for example, FIG. 4A) in Step S202. Next, the CPU 5 determines in Step S203 whether or not there has been a kit selection operation by an operation of the dial switch 27. Thus, the dial switch 27 individually, or in cooperation with the CPU 5, for example, can operate as a selection input device as discussed herein. Here, the kit selection operation is not limited to an operation of the dial switch 27, and can be an operation by another switch. Also, as discussed above with regard to the setting inputs 2, the dial switch 27 can be a push button, a touch pad, a toggle switch or any suitable type of switching device as understood in the art. When there is no kit selection operation, the CPU 5 ends the present flow of process.

If the kit selection operation is performed and a selection of the drum kit is thereby received, the CPU 5 changes (increase or decrease) the kit number 42 according to the received selection in Step S204. Then, the CPU 5 assigns and sets the tone of the drum set defined by the kit number 42 to each of the pads 21. In this case, the CPU 5 sets (changes the tone) corresponding tones defined in the drum kit of the kit number 42 only to the pads 21 in which a tone lock is not set (is off), and the set tone of the pad 21 in which a tone lock is set (is on) is maintained without changing. It is thereby possible to change the drum kit while fixing the set tone of the desired pad 21. The pads 21 in which a tone lock is not set can be referred to as unlocked pad, while the pads 21 in which a tone lock is set can be referred to as a locked pad.

Next, the CPU 5 updates the kit selection screen in Step S206, reflecting the processes of Steps S204 and S205. That is, the CPU 5 changes the displays of the drum set name 41, the kit number 42, and the icon 43. Thereafter, the flow of the process shown in FIG. 6 ends.

Figure 7:
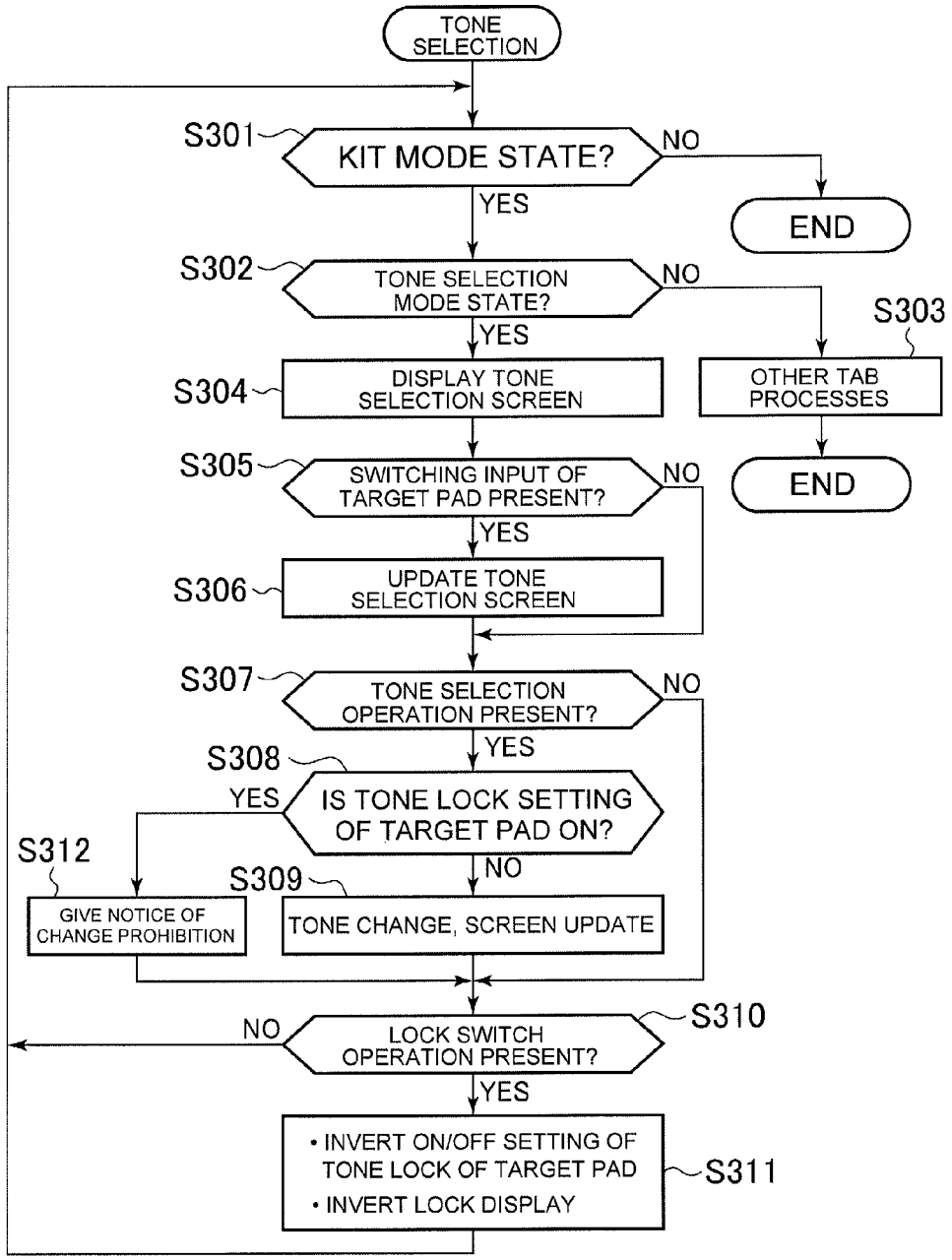
FIG. 7 is a flowchart illustrating an example of a tone selection process including in the process shown in the flowchart of FIG. 5.

FIG. 7 is a flowchart of the tone selection process that is executed in Step S103 in FIG. 5. First, the CPU 5 determines in Step S301 whether or not the electronic percussion instrument 20 is in the KIT mode state, and ends the present process when not in the KIT mode state. If the electronic percussion instrument 20 is in the KIT mode state, the CPU 5 then determines whether or not the electronic percussion instrument 20 is in the tone selection mode state in Step S302. If the electronic percussion instrument 20 is not in the tone selection mode state, the CPU 5 executes other tab processes in Step S303, and ends the flow of the process shown in FIG. 7. In the other tab processes, if there is an operation to cancel the tone selection mode or an operation of other switches or tabs, the flow of processes corresponding to these operations are executed.

If in the tone selection mode state, the CPU 5 causes the display 9 of the controller 23 to display the tone setting screen (for example, FIG. 4B) in Step S304. Next, the CPU 5 determines in Step S305 whether or not there has been a switching input of the striking target pad by a striking of a pad 21, etc., that is different from the current target pad. If a switching input of the striking target pad is not performed, then the CPU 5 advances the process to Step S307. On the other hand, if the switching input of the striking target pad is performed, the CPU 5 updates the display of the target pad name 44 in the tone setting screen according to the switching input (for example, FIG. 4C) in Step S306, and the process advances to Step S307.

In Step S307, the CPU 5 determines whether or not a tone selection operation by an operation of the dial switch 27, etc., has been performed. If a tone selection operation has not been performed, the CPU 5 advances the process to Step S310. However, if a tone selection operation has been performed, the CPU 5 determines whether or not a tone lock has been set to the current target pad (whether or not the setting is on) in Step S308. As a result of that determination, if the tone lock is set to the target pad, then the CPU 5 does not change the tone, and gives a notice that a tone change is prohibited in Step S312. For example, the CPU 5 causes a predetermined mark or message to be displayed on the tone setting screen. Thus, regarding a pad 21 to which a tone lock is set, the set tone is not changed even if there is a change instruction from the user, and the user will be notified of that fact. Thereafter, the process proceeds to Step S310.

As a result of the determination of Step S308, if a tone lock is not set to the target pad, the CPU 5 in Step S309 updates the displays of the tone number 46 and the set tone 45 in the tone setting screen according to the selected operation in Step S307 (for example, FIG. 4C), and the process advances to Step S310. In Step S310, the CPU 5 determines whether or not the lock switch 25 (FIG. 3) has been operated. As a result of the determination, if the lock switch 25 has not been operated, then the CPU 5 returns the process to Step S301. On the other hand, if the lock switch 25 has been operated, then the CPU 5 inverts the on/off setting state of the tone lock of the target pad while inverting the display of the lock display 47 in the tone setting screen in Step S311, and returns the process to Step S301.

According to the disclosed embodiment, it is possible to set a tone lock for each pad 21, and when a selection of the drum kit is received, the set tones are changed only for pads 21 in which a tone lock has not been set, and the set tone is not changed and is maintained in the pads 21 in which a tone lock has been set. It is thereby possible to fix the set tone of the desired pad 21 even if the drum kit is changed.

Further, since the pads 21 to which a tone lock has been set are made known by the lock display 47, it is possible to notify the user of the pads 21 in which the set tone is fixed. In this disclosure, the method of notifying of the setting of the tone lock known is not limited to a visual notification such as the lock display 47 or any other suitable type of display, and can be a notification by voice as well, such as via the sound system 15 or in any other suitable manner, and a combination of visual and audio notification. Hence, the lock display 47 and the sound system 15, individually, in combination with each other, or in combination with the CPU 5, can be referred to as a notification output device. In addition, while the set tone of the pad 21 can be individually changed based on a change instruction from the user, since the set tone of the pads 21 in which a tone lock is set is not changed even if there is a change instruction from the user, it is possible to avoid erroneously changing the set tone of the pad 21 in which the set tone is fixed.

Also, examples were shown in which switches 24-27 function as the main operators, the means of instructing the mode or selection is not limited to these switching methods. Furthermore, pads 21 were shown as an example of a musical performance input device, but the device can be any to which a musical performance is input, and is not limited to a device that is called a pad. In addition, the present invention is not limited to an electronic drum, and can be applied to an electronic percussion or other various electronic percussion instruments. The present invention is also not limited to these specific embodiments, and various embodiments that do not exceed the scope of the invention are also included in the present invention.

General Interpretation of Terms

In understanding the scope of the present invention, the term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An electronic percussion instrument controller comprising:
   - a selection input device configured to select an instrument which defines a tone that corresponds to each of a plurality of musical performance input devices;
   - a setting input device configured to selectively and individually set a tone lock for each of the musical performance input devices; and
   - a processor programmed to maintain a set tone of at least one of the musical performance input devices for which the tone lock is set by the setting input device.

2. The electronic percussion instrument controller according to claim 1, further comprising
   - a notification output device configured to provide notice of the at least one of the musical performance input devices for which the tone lock is set by the setting input device.

3. The electronic percussion instrument controller according to claim 1, wherein
   - the processor is further programmed to change the at least one of the set tone of the musical performance input devices based on a change instruction while the tone lock is not set for the at least one of the musical performance input devices; and
   - the processor is further programmed to refrain from changing the set tone of the at least one of the musical performance input devices based on the change instruction while the tone lock is set for the at least one of the musical performance input devices.

4. The electronic percussion instrument controller according to claim 2, wherein
   - the processor is further programmed to change the set tone of the at least one of the musical performance input devices based on a change instruction while the tone lock is not set for the at least one of the musical performance input devices; and
   - the processor is further programmed to refrain from changing the set tone of the at least one of the musical performance input devices based on the change instruction while the tone lock is set for the at least one of the musical performance input devices.

5. The electronic percussion instrument controller according to claim 1, wherein
   - the setting input device includes a switch that is operated to selectively and individually set and unset the tone lock for each of the musical performance input devices.

6. The electronic percussion instrument controller according to claim 1, wherein
   - the processor is further configured to select the at least one of the musical performance input devices, for changing of the set tone, in response to a striking of the at least one of the musical performance input devices.

7. The electronic percussion instrument controller according to claim 2, wherein the notification output device is configured to provide the notice as at least one of visual information and audio information.

8. An electronic percussion instrument comprising the electronic percussion instrument controller according to claim 1, and further comprising at least one pad as the at least one of the musical performance input devices, the at least one pad being linked to the processor.

9. The electronic percussion instrument according to claim 8, wherein the at least one pad includes a plurality of pads linked to the processor.

10. The electronic percussion instrument according to claim 9, wherein the pads are arranged to form a drum set.

11. An electronic percussion instrument controller comprising:

a selection input device configured to select an instrument which defines a tone that corresponds to each of a plurality of musical performance input devices;

a setting input device configured to selectively and individually set a tone lock for each of the musical performance input devices; and a processor, programmed to, in response to the selection of the instrument selected by the selection input device, change a set tone of at least one of the musical performance input devices for which the tone lock is not set by the setting input device to a corresponding tone defined in the instrument that is selected by the selection input device.

12. A method for controlling an electronic percussion instrument comprising:

selecting an instrument which defines a tone that corresponds to each of a plurality of musical performance input devices;

selectively and individually setting a tone lock for each of the musical performance input devices; and maintaining, by a processor in response to the selection of the instrument selected by a selection input device, a set tone of at least one of the musical performance input devices for which the tone lock is set by a setting input device.

13. The method according to claim 12, further comprising providing notice of the at least one of the musical performance input devices for which the tone lock is set by the setting input device.

14. The method according to claim 12, further comprising changing the set tone of the one of the musical performance input devices based on a change instruction while the tone lock is not set for the at least one of the musical performance input devices; and wherein the maintaining refrains from changing the set tone of the at least one of the musical performance input devices based on the change instruction while the tone lock is set for the at least one of the musical performance input devices.

15. The method according to claim 13, wherein changing the set tone of the at least one of the musical performance input devices based on a change instruction while the tone lock is not set for the at least one of the musical performance input devices; and wherein the maintaining refrains from changing the set tone of the at least one of the musical performance input devices based on the change instruction while the tone lock is set for the at least one of the musical performance input devices.

16. The method according to claim 12, wherein the selectively and individually setting includes operating a switch to selectively and individually set and unset the tone lock for each of the musical performance input devices.

17. The method according to claim 12, further comprising selecting, by the processor, the at least one of the musical performance input devices, for changing of the set tone, in response to a striking of the at least one of the musical performance input devices.

18. The method according to claim 13, wherein the providing of the notice includes providing at least one of visual information and audio information.

* * * * *